United States Patent [19]

Ashina

[11] 4,385,699

[45] May 31, 1983

[54] METHOD AND APPARATUS FOR INSPECTING EMPTY CANS ENTIRELY AUTOMATICALLY

[75] Inventor: Masato Ashina, Yokosuka, Japan

[73] Assignee: Toyo Seikan Kaisha, Ltd., Tokyo, Japan

[21] Appl. No.: 191,646

[22] Filed: Sep. 26, 1980

[30] Foreign Application Priority Data

May 28, 1980 [JP] Japan ..... 55-70066

[51] Int. Cl.[3] ..... B07C 5/344

[52] U.S. Cl. ..... 209/538; 209/556; 209/558

[58] Field of Search ..... 209/538, 546, 549, 551, 209/555, 556, 558, 563–566, 567, 571, 597; 324/237, 238, 240

[56] References Cited

U.S. PATENT DOCUMENTS

| | | | |
|---|---|---|---|
| 2,742,151 | 4/1956 | Milford | 209/538 |
| 3,416,659 | 12/1968 | Linderman et al. | 209/565 |
| 3,880,750 | 4/1975 | Butler et al. | 209/538 X |
| 4,002,966 | 1/1977 | Hinds et al. | 324/238 |
| 4,029,958 | 6/1977 | Wright | 209/555 X |
| 4,042,877 | 8/1977 | Sieverin | 209/567 X |
| 4,105,122 | 8/1978 | Flood et al. | 209/556 |

*Primary Examiner*—Robert B. Reeves
*Assistant Examiner*—Edward M. Wacyra
*Attorney, Agent, or Firm*—Jordan & Hamburg

[57] ABSTRACT

Method and apparatus for inspecting empty cans entirely automatically includes a flange inspecting process and a drawing condition inspecting process. The flange and the drawing condition inspections are simultaneously carried out in the same inspecting station during the forcible rotation of the can. The flange portion is checked for craks and length, and the outer body surface is checked for the drawing conition respectively in a non-destructive and contactless manner by utilization of static electromagnetic inspection and light reflection inspection methods. A prestored reference value signal, which is compared with a converted electrical signal for the determination of whether cans are good or not, is a signal of a value calculated by a microcomputer on the basis of values which are sampled, equally divided, signal values corresponding to one rotation of a forcibly rotated standard good empty can.

12 Claims, 28 Drawing Figures

Fig.1
PRIORART
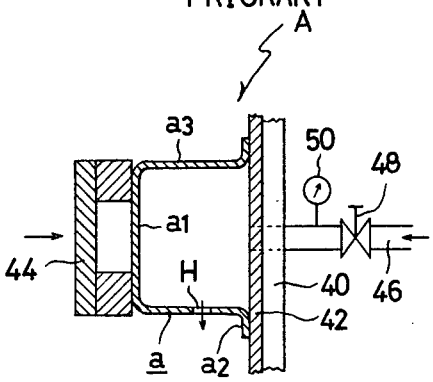
Fig.2
PRIORART
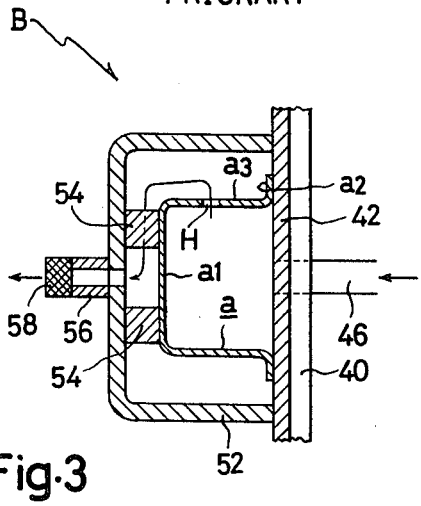
Fig.3
PRIORART
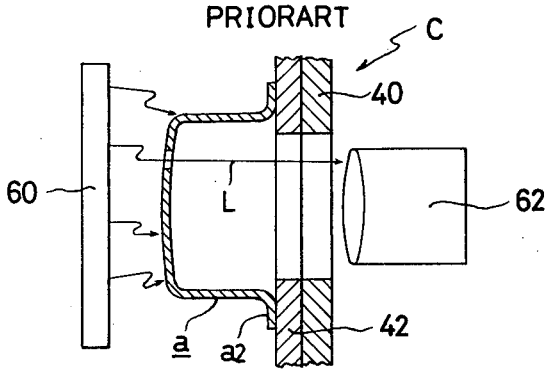

METHOD AND APPARATUS FOR INSPECTING EMPTY CANS ENTIRELY AUTOMATICALLY

This invention relates to a method of inspecting empty cans entirely automatically and also to an apparatus to be used directly for working the said method, in which defects such as pin-hole, crack, insufficient flange length, bending and stain, which would impede a hermetical seal or cause leakage, as well as an omission or unevenness in printing of the pattern printed on the outer peripheral surface of empty cans, are, if any, detected automatically throughout the body, bottom and flange protions of two-piece cans as steel drawing and ironing (SDI) cans made of tin-plate, black plate or tin-free steel, and the defective empty cans having any or all of such defects are sorted out and removed.

For checking defects of the flange portion of empty cans of this sort, there have heretofore been adopted the air tester method and the light tester method. The former air tester method is applied in such forms as shown in FIGS. 1 and 2. In the air tester (A) shown in FIG. 1, an open end of an empty can (a) is urged, by means of a pusher (44) from a bottom portion thereof (a1), to a side of a base plate (40) on which side is affixed a rubber (42) or the like, then an air pressurized to about 1 kg/cm$^2$ is fed to the interior of the can through an air pipe (46), then a valve (48) is closed and, after a certain time has elapsed, a drop in pressure within the empty can (a) is checked with a pressure gauge (50), e.g. a diaphragm type pressure gauge. In the air tester (B) shown in FIG. 2, the open end of the empty can (a) is kept urged to the rubber (42) of the base plate (40) by pushing the bottom portion (a1) by means of a pusher (54) within a sealing cover (52), while air pressurized to about 1 kg/cm$^2$ is fed continuously to the interior of the empty can (a) through the air pipe (46), under which condition an air flow leaking out of a pin-hole (H) and going toward a detecting port (56) is sensed by a net (58) stretched at an end of the detecting port (56), and the resulting vibration is amplified and thus the presence or absence of a defect is judged on the basis of the degree of leakage of air.

On the other hand, the above-mentioned light tester method is applied in such a manner as illustrated in FIG. 3; that is, in the light tester (C), the empty can (a) is brought into close contact with the rubber or the like (42) affixed on the base plate (40) by a suitable adsorbing means, for example, by applying a negative pressure to the interior of the empty can (a), and a leak light (L) from an external light source (60) is detected by a photo detector (62) such as a photomultiplier tube whereby the presence or absence of a defect is judged.

Both conventional methods hereinabove described cannot display their abilities unless the flange portion (a2) is closely contacted with the rubber material or the like (42), so that the flange portion (a2) cannot easily be checked for cracks and after all defects in the flange portion (a2) are often overlooked. Besides, in the case of drawing and ironing (DI) cans, the occurrence of cracks is frequent particularly in the flange portion, so in both such conventional methods there are specially disposed checking staffs after passing the testers (A), (B) and (C) to visually check the flange portion of all empty cans for cracks, and thus human wave tactics are adopted. However, a human check often involves oversights, and it is impossible to exclude defective cans containing defects in the inside of the material thereof which cannot visually be checked, resulting in that the inspection becomes time-consuming, inefficient and ineffective. This is now the greatest bottle neck in the can manufacturing line.

In addition to cracked empty cans, in the foregoing crack test process there often come from the preceding process empty cans whose flange length is insufficient caused by defective trimming in the trimming operation, as well as empty cans (a) with an abnormal print pattern found on the outer peripheral surface of the body portion (a3) which is attributable to an omission or unevenness in printing occurred when treated with a printer and a coater. If these defective empty cans are to be detected visually by man and necessary measures are to be taken after locating in which stage the error has occurred, it will just consume a lot of time as in the foregoing cracked can detection and this is very inefficient and ineffective.

The method and apparatus for inspecting empty cans entirely automatically of this invention are to be adopted in the flange inspecting process and the drawing condition inspecting process wherein empty cans are forcibly rotated while their flange portions and outer peripheral surface are simultaneously checked for cracks and length, and the printed drawn condition respectively in a non-destructive and contactless manner by utilization of the static electromagnetic inspection method and the light reflection inspection method, and the apparatus of this invention is provided with a flange crack tester, said flange crack tester including at least an empty can feed/discharge mechanism for conveying continuously incoming empty cans one by one in an equally spaced manner to a predetermined position on an inspecting station, a rotating mechanism for forcibly rotating the empty cans positioned in the said inspecting station, a permanent magnet for exerting a static magnetic field on the flange portion of the empty cans rotating in the inspecting station, a magnetic head and a photo sensor facing near one side of the flange portion of the empty cans rotating in the inspecting station, photo sensors for receiving an amount of reflection of light radiated onto the outer peripheral surface of an empty can on which the reflection amount varies as a function of the drawn condition of the printed pattern, a discriminator circuit for comparing electrical detection signals output from the said magnetic head and photo sensor with a preset standard level and making discrimination on the results, and a rejector for sorting defective empty cans from good empty cans upon receipt of a reject command signal which is output from the said discriminator circuit.

The explanation about to be given is concerned with the case where the crack tester of this invention is disposed after the air tester (A) or (B) or the light tester (C). But the crack tester may be disposed before the air tester (A) or (B) or the light tester (C) and in the inspection process the flange portion (a2) of the empty can (a) may be checked first, then subsequently the bottom portion (a1) and the body portion (a3) may be checked. However, the former, that is, disposing the crack tester after the air or light tester, is preferable. This is because in the inspection of the body and bottom portions by means of the preceding air tester (A), (B) or light tester (C) the flange portion (a2) is kept in close contact with the rubber material (42) of the base plate (40) so that a fine crack if any in the flange portion (a2) is expanded whereby the subsequent inspection of the flange portion (a2) by the crack tester can be effected more efficiently.

According to this invention, the bottom portion (a1) and the body portion (a3) of the empty can (a) are checked preponderantly in the first half of the inspection process, while the flange portion (a2) is checked preponderantly in the latter half of the inspection process, and thus perfection is aimed at by covering throughout the empty can (a), further even flange cracks often occurring in steel drawing and ironing (SDI) cans are detected to thereby improve the quality assurance and thus flange-cracked empty cans can also be removed in addition to empty cans defective in their bottom and body portions whereby the operation for sorting out the total number can be omitted.

In this invention, moreover, both flange cracks and flange length defects occurring in SDI cans can be exactly detected by the magnetic inspection method and by perception with a photo sensor, and at the same time the existence of defective prints such as omission and unevenness in printing of the pattern printed on the outer peripheral surface of the body portion (a3) of empty can also be detected at once, and these defective empty cans can be removed automatically. Thus it was made possible by this invention to check exactly the existence of defects which by human checking have often been overlooked or have been invisible, and further to automatically remove defective cans (a') in which is present a defective print such as omission or unevenness in printing, whereby the quality can be improved and a rational checking system can be attained.

It is an object of this invention to provide a method and apparatus for inspecting empty cans entirely automatically which ensures a system aiming at perfection of inspecting process control and quality control for empty cans.

It is another object of this invention to provide a method and apparatus for inspecting empty cans entirely automatically whereby defects such as pin-holes, cracks, insufficient flange length, bending and stain, which would impede a hermetical seal or cause leakage, can be detected automatically throughout the body, bottom and flange portions of the empty cans.

It is a further object of this invention to provide a method and apparatus for inspecting empty cans entirely automatically whereby an omission or unevenness in printing of the pattern printed on the outer peripheral surface of the empty cans can be detected automatically.

It is another object of this invention to provide a method and apparatus for inspecting empty cans entirely automatically whereby defective empty cans can be sorted out and removed.

It is a further object of this invention to provide a method and apparatus for inspecting empty cans entirely automatically whereby an abnormality of the pattern printed on the outer peripheral surface of the empty cans can be detected and at the same time the kind of the said abnormality can be displayed.

It is a further object of this invention to provide a method and apparatus for inspecting empty cans entirely automatically whereby in the stage before or after the conventional body portion inspecting process with an air or light tester there can be additionally provided a flange portion inspecting process using a newly and specially provided flange crack tester.

It is a still further object of this invention to provide a method and apparatus for inspecting empty cans entirely automatically which method and apparatus are interposed between the can body maker and the delivery machine whereby an integrated continuous systematization can be attained.

Other and further objects of this invention will become apparent from the following description and also from the description of the accompanying drawings.

In the drawings:

FIGS. 1 and 2 illustrate how to check leakage with conventional air testers;

FIG. 3 illustrate how to check leakage with a conventional light tester;

Figure 4:
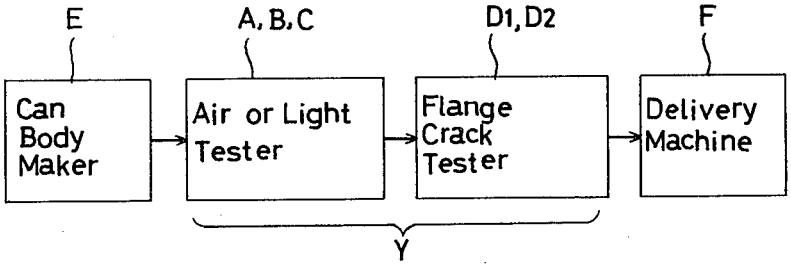
FIG. 4 is a block diagram showing how the apparatus of this invention is disposed in the can manufacturing line system.

A first embodiment of the apparatus of this invention is here described with reference to FIG. 4.

The entirely automatic inspecting apparatus (Y) of this invention is an apparatus for detecting defects concerned with the sealing property of the empty can (a), in which in the front stage is disposed the conventional air tester (A) or (B) or light tester (C) to check the body portion (a3) and the bottom portion (a1) of the empty can (a) for defects such as pin-holes, rubbed flaws and scratches, while in the rear stage is disposed a flange crack tester (D1) for checking the flange portion (a2) of the empty can (a) being forcibly rotated for defects such as cracks, and thus both testers are disposed as a two-stage construction intermediate between the can body maker (E) and the delivery machine (F) and these sections are made mutually connectable to form a line, whereby the empty can (a) after leaving the can body maker (E) and before reaching the delivery machine (F) passes through any of the testers (A), (B) and (C) and also through the tester (D1), that is, the body portion (a3) and the bottom portion (a1) of the empty can (a) are checked for defects perponderantly in the front stage and the flange end portion (a2) is checked for defects preponderantly in the rear stage.

The flange crack tester (D1) includes an empty can feed/discharge mechanism (G1) which receives a continuously incoming group of empty cans (a) one by one from an empty can feed station (S1), then conveys the empty cans (a) intermittently in an equally spaced manner to a predetermined position in a static magnetic field on an inspecting station (S2) magnetized with a set permanent magnet (PM) and thereafter conveys them intermittently to a discharge station (S3); a rotating mechanism (H1) for forcibly rotating the empty cans (a) positioned and stopped in the inspecting station (S2); a magnetic head (MGH) which faces near one side of the outer periphery of the flange portion (a2) of the empty can (a) being rotated; a defective empty can discriminator circuit (J) for comparing an electrical detection signal (i1) output from the magnetic head (MGH) with a preset standard level and discriminating the results; and a rejector (R1) for sorting defective empty cans (a') from good empty cans (a") upon receipt of reject command signals ($iz_1$)($iz_2$)($iz_3$) which are output from the defective empty can discriminator circuit (J).

Figure 5:
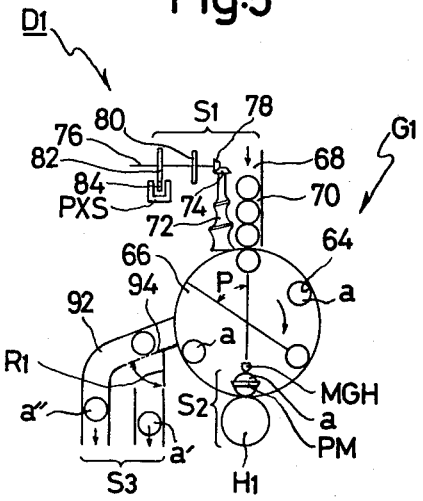
FIG. 5 is a schematic illustration of an empty can feed/discharge mechanism according to a first embodiment.

The empty can feed/discharge mechanism (G1) according to the first embodiment shown in FIG. 5 includes an indexing turret (66) on the outer periphery of which are disposed six pockets (64) for receiving and holding the empty cans (a), the pockets (64) being equally spaced at an indexing pitch (P); the empty can feed station (S1) disposed on the upper side of the outer periphery of the indexing turret (66); the inspecting station (S2) disposed on the lower side of the outer periphery of the indexing turret (66), that is, on the opposite side to the empty can feed station (S1); and the discharge station (S3) disposed on an outer side of the indexing turret (66) in a position just after an angular pivoting by one indexing pitch (P) in the arrow-marked clockwise direction from the inspecting station (S2).

The empty can feed station (S1) includes an empty can feed path (68), a side guide (70), a timing screw (72) which extends in parallel with the side guide (70), the side guide and the timing screw (72) being disposed with the empty can feed path (68) put therebetween, an infeed drive shaft (76), a bevel gear (74) fixed to an end of the timing screw (72), a bevel gear (78) fixed to an end of the infeed drive shaft (76), the bevel gears (74) and (78) meshing at a right angle with each other, a driving input wheel (80) and a timing plate (82) both fixed coaxially on the infeed drive shaft (76) adapted to synchronize so as to rotate once for each angular pivoting by one indexing pitch (P) of the indexing turret (66), and a -shaped proximity switch (PXS) as a timing sensor facing near the outer periphery of the timing plate so that a projection (84) projecting from one side of the outer periphery of the timing plate (82) can pass therethrough.

Figure 6:
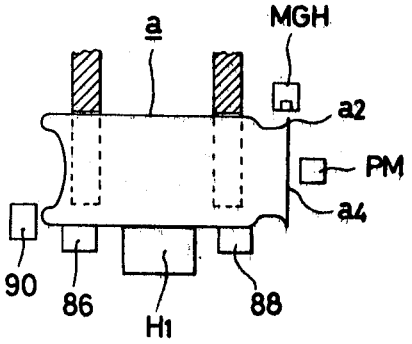
FIG. 6 is an enlarged sectional view of the principal part of an inspecting station in the first embodiment.

The inspecting station (S2) includes, as shown in FIG. 6, the permanent magnet (PM) facing the center of an opening portion (a4) of the empty can (a) which is held in a sideways state in the pocket of the indexing turret (66) and stops in a predetermined position along arc-shaped parallel side guides (86) (88) and end guide (90), the magnetic head (MGH) mounted just above the flange portion (a2) of the empty can (a), and the rotating mechanism (H1) consisting of a paddle wheel adapted to rotate at high speed for transmission of driving torque to the lower side of the central portion of the outer periphery of the empty can (a) and being disposed so as to be capable of contacting externally with the said portion of the empty can (a).

The discharge station (S3) includes an empty can discharge path (92), a chute (94) formed in the bottom portion of the empty can discharge path (92) in a position near the inlet of the same path, and a single-leaf open/close door type rejector (R1) hinged to the chute (94) so as to be pivotally opened or closed.

Figure 7:
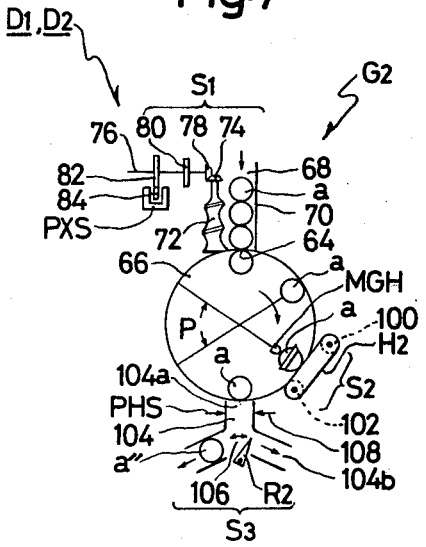
FIG. 7 is a schematic illustration of an empty can feed/discharge mechanism according to a second embodiment.

In FIG. 7 there is shown an empty can feed/discharge mechanism (G2) according to a second embodiment of the invention, which includes the same indexing turret (66) as that used in the first embodiment, the same empty can feed station (S1) as that used in the first embodiment disposed on the upper side of the outer periphery of the indexing turret (66), an inspecting station (S2) disposed on an oblique side of the outer periphery of the indexing turret (66) in a position moved by two indexing pitches (2P) in the arrow-marked clockwise direction from the empty can feed station (S1), and an empty can discharge station (S3) disposed on the lower side of the outer periphery of the indexing turret (66), that is, on the opposite side to the empty can feed station (S1), in which to the same portions as in the first embodiment were affixed the same marks.

Figure 8:
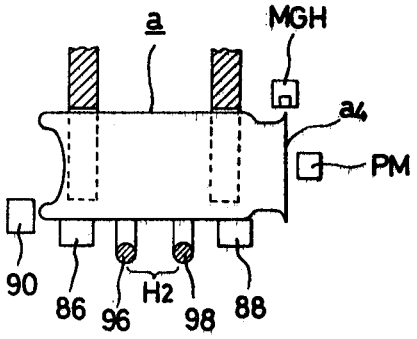
FIG. 8 is an enlarged sectional view of the principal part of an inspecting station in the second embodiment.

The inspecting station S2 includes, as shown in FIG. 8, an empty can spinner type rotating mechanism (H2), the rotating mechanism (H2) comprising a pair of parallel endless belts (96) and (98) adapted to run at high speed for transmission of driving torque to both sides of the central portion on one side of the outer periphery of the empty can (a) which stop in a predetermined position in the inspecting station (S2) and being stretched between a driving wheel (100) and a driven wheel (102) so as to be engageable with the said portion of the empty can (a).

The discharge station (S3) includes an empty can discharge path (106) having a bifurcated branch point (106) in which is pivoted the base end of a sorting arm type rejector (R2) for pivotal change-over operation, and a pair of projector (108) and photo sensor (PHS) as a timing sensor for sensing the passing of the empty can (a) after inspection, the projector (108) and the photo sensor (PHS) being disposed near an inlet (104*a*) of the empty can discharge path (104) with the discharge path (104) put therebetween.

Figure 9:
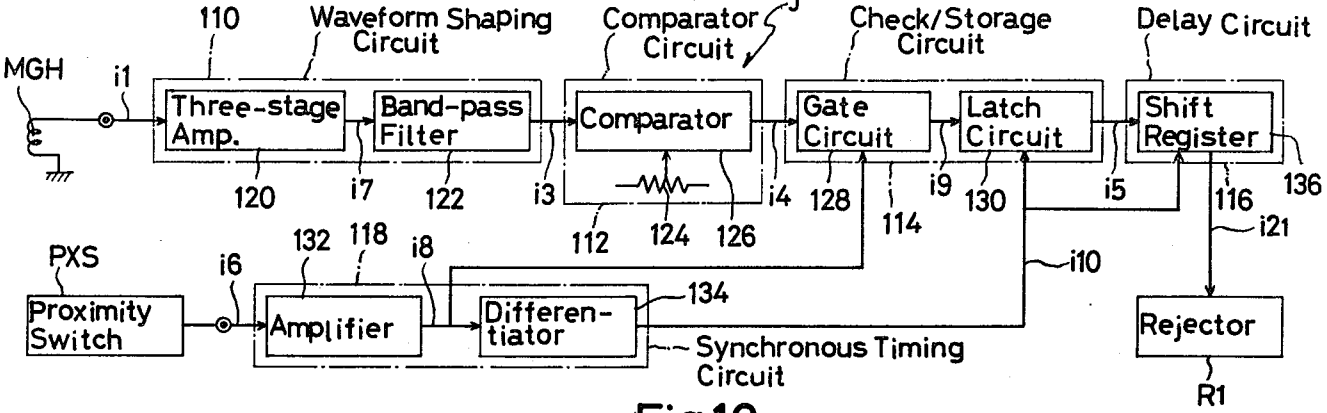
FIG. 9 is a block diagram of a discriminator circuit having a delay circuit according to a first embodiment.

The discriminator circuit (J) includes, as shown in FIG. 9, a waveform shaping circuit (110) for amplifying and filtering the electrical detection signal (i1) output from the magnetic head (MGH), a comparator circuit (112) for comparing a shaped defect signal (i3) output from the waveform shaping circuit (110) with a preset level, a check/storage circuit (114) for checking and preventing the passing of an erroneous signal of a defect signal (i4) output from the comparator circuit (112), allowing only correct signals to pass and temporarily storing them, a delay circuit (116) for delaying a defect storage signal (i5) output from the check/storage circuit (114) for a predetermined time interval in the unit of seconds and then outputting a reject command signal ($iZ_1$) to the rejector (R1), and a synchronous timing circuit (118) for inputting an electrical timing signal (i6) from the proximity switch (PXS) as a timing sensor to both the check/storage circuit (114) and the delay circuit (116).

The waveform shaping circuit (110) consists of a three-stage amplifier (120) for amplifying the electrical detection signal (i1) output from the magnetic hand (MGH) after magnetoelectric conversion from 4,500 to 27,000 times, and a band-pass filter (122) which is the combination of a high-pass filter e.g. of fc=500 Hz, 36 db/Oct which attenuates any other components than the defect signal components of an amplified electrical detection signal (i7) such as a mechanical vibration of the empty can (a) and a low-pass filter e.g. of fc=2.5 kHz, 18 db/Oct which absorbs a high-frequency noise etc., the three-stage amplifier (120) and the band-pass filter (122) being disposed in series from which is output the shaped defect signal of for example 3–30 V.

The comparator circuit (112) consists of a comparator (126) to which is attached a setter (124), in which the shaped defect signal (i3) is checked for level in a preset standard level voltage value range of 1–5 V, and when the shaped defect signal (i3) is larger than the preset standard level there is output the defect signal (i4).

The check/storage circuit (114) consists of a gate circuit (128) and a latch circuit (130) connected in series, in which upon receipt of an amplified timing signal (i8) from the synchronous timing circuit (118) the gate circuit (128) allows the passing of a correct defect signal (i9), which signal (i9) is then temporarily stored and stands by in the latch circuit (130), and when a differentiated timing signal (i10) from the synchronous timing circuit (118) is received, the defect storage signal (i5) is output to the delay circuit (116).

The synchronous timing circuit (118) consists of an amplifier (132) for amplifying the electrical timing signal (i6) from the proximity switch (PXS) which is adjusted to operate during inspection of the empty can (a), and a differentiator (134) for differentiating the amplified timing signal (i8), the amplifier (132) and the differentiator (134) being connected in series, in which the amplified timing signal (i8) is transmitted to the gate circuit (128) to open the latter only during operation of the proximity switch (PXS) which is adjusted to operate only during a period of time during which the empty can (a) which is positioned in the inspecting station (S2) rotates stably once or more, and if the correct defect signal (i9) occurs during that one rotation it is temporarily stored and stands by in the following latch circuit (130), while the defect storage signal (i5) which stands by in the latch circuit (130) is excited so as to be output to the delay circuit (116) at the last timing of the differentiated timing signal (i10), in other words, the electrical timing signal (i6).

The delay circuit (116) in the first embodiment shown in FIG. 9 consists of a shift register (136) which, at every receiving of the differentiated timing signal (i10) from the synchronous timing circuit (118), successively shifts the defect storage signal (i5) output from the check/storage circuit (114), and when the empty can (a) after inspection approaches the chute (94) of the rejector (R1) it outputs the reject command signal ($i2_1$).

Figure 10:
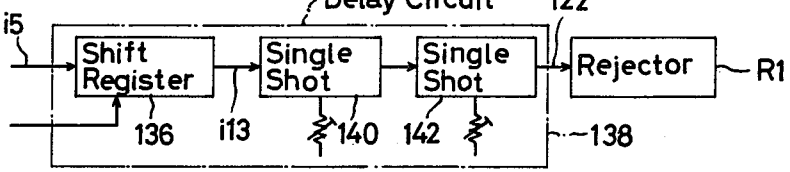
FIG. 10 is a block diagram of a delay circuit according to a second embodiment.

In FIG. 10 there is shown a delay circuit (138) according to a second embodiment, in which two-stage single shots (140) (142) are disposed in series after a shift register (136) which is like that used in the first embodiment to make time adjustment possible in the range of from 30 msec to 300 msec, and thus the operation timing is taken for opening or closing the chute (94) of the rejector (R1).

Figure 11:
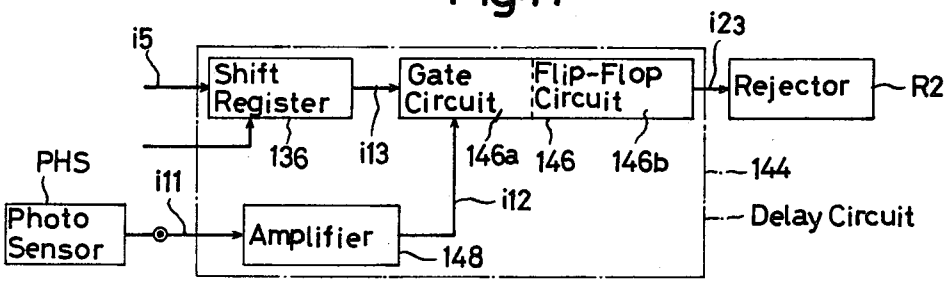
FIG. 11 is a block diagram of a delay circuit according to a third embodiment.

In FIG. 11 there is shown a delay circuit (144) according to a third embodiment, in which a gate & flip-flop circuit (146) is disposed in series after a shift register (136) which is like that used in the first embodiment whereby only when a sense signal (i12), which is an amplified signal by an amplifier (148) of a checked empty can passing sense signal (i11) from the photo sensor (PHS) as a photo switch, is received by the front-stage gate portion (146*a*) the passing of a defect transfer signal (i13) is allowed, and just before arrival of the checked empty can (a) in question there is output a reject command signal ($i2_3$) to the rejector (R2) and thus a pivotal change-over timing is taken.

In the first embodiment of the method of this invention, the empty can inspecting process in the can manufacturing system combines a step in which the body portion (a3) and the bottom portion (a1) of the empty can (a) are checked for leakage by utilization of air or light as a detection medium, and a step in which while the empty can (a) is forcibly rotated the flange portion (a2) is checked for crack in a non-destructive contactless manner by utilization of the static electromagnetic inspection method, both steps being successively disposed as a front/rear two-stage construction, whereby a thorough inspection is made throughout the empty can entirely automatically. A more detailed explanation is here given while referring to FIGS. 5 through 16.

The empty cans (a) with their inner surfaces coated after leaving the can body maker (E) are subjected to inspection with the air tester (A) or (B) or light tester (C) as heretofore, in which the bottom portion (a1) and the body portion (a3) are checked for leakage according to predetermined detecting operations and defective empty cans (a') are removed, then the empty cans (a) are conveyed continuously to the empty can feed station (S1) of the empty can feed/discharge mechanism (G1) or (G2) in the flange crack tester (D).

The empty cans (a) which have entered the empty can feed station (S1) are arranged in a row along and within the empty can feed path (68) by means of the timing screw (72), and by turning once the timing screw (72) through rotatiobn of the infeed drive shaft (76) in synchronism with the intermittent indexing rotation of the indexing turret (66), one of the pockets (64) in the indexing turret (66) arrives at the empty can feed station (S1), to which is delivered one of the empty cans (a) whereupon the electrical timing signal (i6) is issued from the proximity switch (PXS).

Figure 12:
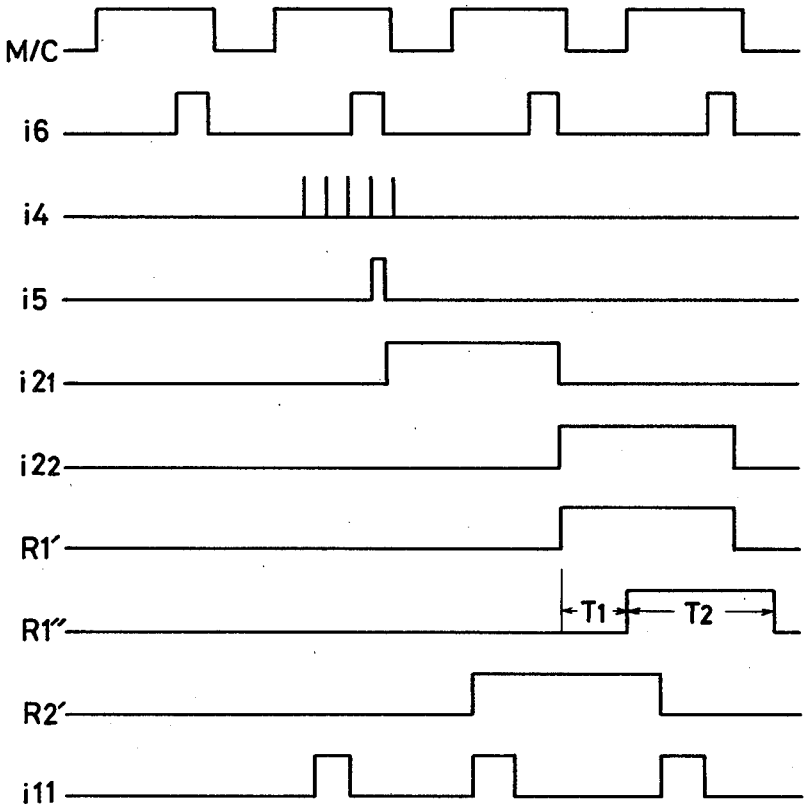
FIG. 12 is a signal timing chart of various portions in the invention.

The empty can (a) which has been received in a sideways fallen state into the pocket (64) at the empty can feed station (S1) is guided by the parallel side guides (86) (88) and end guide (90) along with the intermittent indexing rotation of the indexing turret (66) shown in terms of an operating waveform M/C in FIG. 12 and is brought into contact with the paddle wheel as the rotating mechanism (H1) or the can spinner as the rotating mechanism (H2) in the inspecting station (S2), whereupon it stops in that position.

Figure 13:
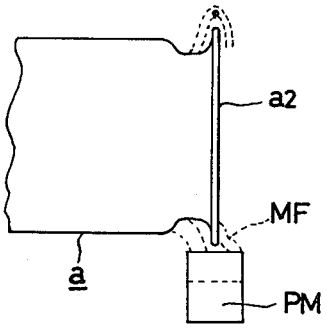
FIGS. 13 and 14 are front and right side views respectively of the principal part showing the principle of detection by the static electromagnetic inspection method of the invention.
Figure 14:
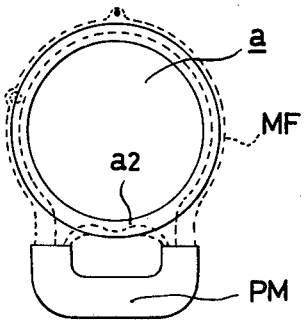
Figure 15:
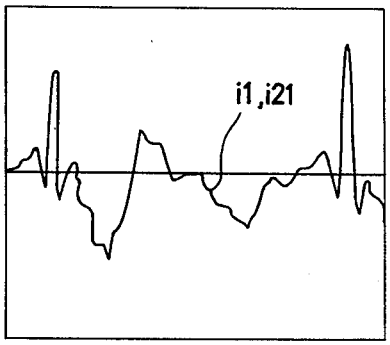
FIG. 15 is a waveform graph of an electrical detection signal output from a magnetic head.

When the empty can (a) has stopped in the predetermined position in the inspecting station (S2), as shown in FIG. 6 or FIG. 8, the paddle wheel of the rotating mechanism (H1) or the can spinner of (H2) is driven to forcibly rotate the empty can (a) at high speed resulting in that, as is illustrated in FIGS. 13 and 14 which show the inspection principle of the static electromagnetic inspection method, the magnetic field intensity about the flange portion (a2) of the empty can (a) positioned within a static magnetic field (MF) of the permanent magnet (PM) assumes a value inversely proportional to the square of distance if the interior of the can material is in a state of magnetic saturation. When the empty can (a) is rotated in the circumferential direction within such magnetic field, there will be no change in the magnetic field intensity if the empty can (a) has a theoretical dimensional accuracy. But if there is any dimensional defect (in roundness or wall thickness), incorporation of a foreign matter in the can material, deformation, or flaw, the magnetic field intensity changes. This change in the magnetic field intensity is converted for example into the electrical detection signal (i1) shown in the graph of FIG. 15 by means of the magnetic head (MGH) which faces near the flange portion (a2).

Figure 16:
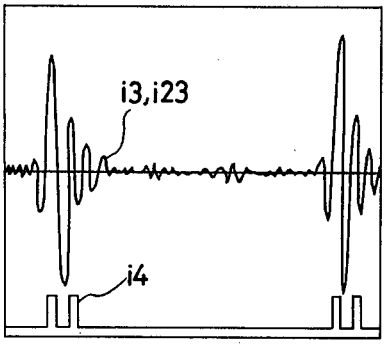
FIG. 16 is a waveform graph of signals output from a bandpass filter and a comparator.

The electrical detection signal (i1) is input to the waveform shaping circuit (110) of the discriminator circuit (J) shown in FIG. 9 and amplified by the amplifier (120), then passes through the band-pass filter (122), from whch there is output the shaped defect signal (i3) with an increased S/N ratio as shown in the graph of FIG. 16. Next, in the following comparator circuit (112) a comparison is made with the voltage level value preset by the setter (124) and for a larger value than the preset level value the defect signal (i4) shown in FIGS. 12 and 16 is input to the gate circuit (128) of the check/storage circuit (114), and at the same time only when the timing signal (i8), which is an amplified signal by the amplifier in the synchronous timing circuit of the electrical timing signal (i6) from the proximity switch (PXS), has been input to the gate circuit (128) the passing as the correct defect signal (i9) is allowed to the latch circuit (130), while in the other cases the passing is shut off as the erroneous defect signal.

Upon passing through the gate circuit (128) the correct defect signal (i9) is stored temporarily and when the differentiated timing signal (i10) after differentiation of the amplified timing signal (i8) by the differentiator (134) in the synchronous timing circuit (118) is received by the latch circuit (130), the defect stored defect signal (i5) is delivered to the delay circuits (116), (138) and (144).

The defect storage signal (i5) transmitted to the shift register (136) of the delay circuit (116) shifts stepwise and successively one by one through the shift register (136) at every receiving of the next and following differentiated timing signals (i10) from the synchronous timing circuit (118), and finally the reject command signal ($i2_1$) shown in FIG. 12 is output to the rejector (R1) through which is about to pass the checked empty can (a) in question to bring the rejector (R1) into the open condition shown in terms of an operating waveform (R1') in FIG. 12 whereby the defective can (a') is selectively dropped into the chute (94).

The defect storage signal (i5) transmitted to the shift register (136) of the delay circuit (138) shifts stepwise and successively one by one through the shift register (136) at every receiving of the next and following differentiated timing signals (i10) from the synchronous timing circuit (118), and the defect transfer signal shown in FIG. 12 which has once been output is passed through the following two-stage single shots (140) (142) and at the end of a predetermined time interval in the unit of second (T1) the reject command signal ($i2_2$) is output to the rejector (R1) through which is about to pass the checked empty can (a) in question to bring the rejector (R1) into an open condition for a period of time T2 in the unit of second as is shown in terms of an operating waveform (R1'') in FIG. 12 whereby the defective can (a') is selectively dropped into the chute (94).

The defect storage signal (i5) transmitted to the shift register (136) of the delay circuit (144) shifts stepwise and successively one by one through the shift register (136) at every receiving of the next and following differentiated timing signals (i10) from the synchronous timing circuit (118), and the defect transfer signal (i13) which has once been output is passed through the gate & flip-flop circuit (146); in this case, only when the amplified passing sense signal (i12), which is an amplified signal by the amplifier (148) of the passing sense signal (i11) shown in FIG. 12 of the checked empty can (a) in question from the photo sensor (PHS) mounted in the rejector (R2) is received, the defect transfer signal (i13) is allowed to shift into the flip-flop circuit (146*b*) and thus the flip-flop circuit (146*b*) is actuated by the defect transfer signal (i13) which has passed the gate circuit (146*a*), and finally the reject command signal ($i2_3$) is output to the rejector (R2) through which is about to pass the empty can (a) in question to bring the rejector (R2) into a stand-by condition for pivotal change-over as is shown in terms of an operating waveform (R2') in FIG. 12 whereby the defective empty can (a') is sorted out into a defective can discharging branch path (104*b*).

Figure 17:
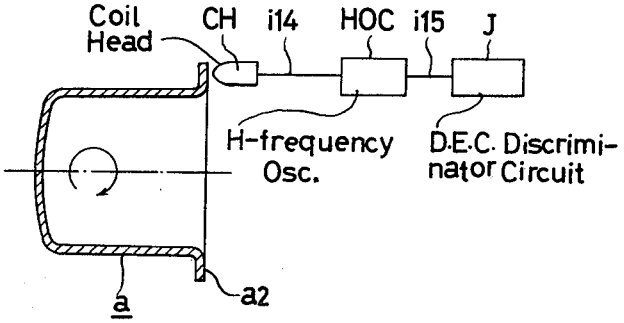
FIG. 17 is a block diagram of the eddy-current inspection method of the invention.

Now an explanation is given with reference to FIG. 17 about the crack inspection by utilization of the eddy-current inspection method in a non-destructive contactless manner. A coil head (CH) is used as the oscillation coil portion of a high frequency oscillator (HOC) and it is positioned so as to face one side of the flange portion (a2) of the empty can (a) which stands by in the inspecting station (S2) whereby the so-called eddy current phenomenon is utilized in which the oscillation frequency differs according to variation in the bonding degree caused by changes in the condition of metal texture. An electrical detection signal (i14) detected by the coil head (CH) is passed through the high frequency oscillator (HOC), from which is output an oscillation frequency signal (i15), which in turn is input to the defective empty can discriminator circuit (J), and after amplification and waveform shaping it is set to a fixed level. A defect of the flange portion (a2) is detected by comparison with the standard frequency level and a defect signal (i4) which is like the one used in the static electromagnetic inspection method is output. The defect signal (i4) is then treated in the same manner as in the static electromagnetic inspection method and the open/close door or sorting arm of the rejector (R1) or (R2) is operated to sort out the defective can (a'). Another embodiment of the flange crack tester of this inventin will be explained with FIGS. 7 and 18 to 22.

Figure 18:
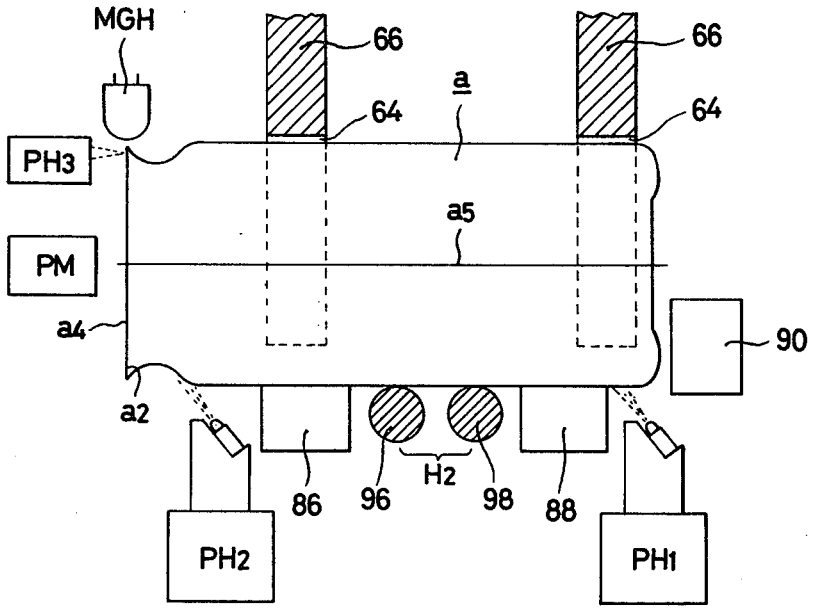
FIG. 18 is a schematic illustration of the principal part on an enlarged scale of an inspecting station according to another embodiment in the apparatus of the invention.

A flange crack tester (D2) includes an empty can feed/discharge mechanism (G2) same as that shown in FIG. 7 which receives a continuously incoming group of empty cans (a) one by one from an empty can feed station (S1), then conveys the empty cans (a) intermittently in an equally spaced manner to a predetermined position in a static magnetic field on an inspecting station (S2) magnetized with a set permanent magnet (PM)

and thereafter conveys them intermittently to a discharge station (S3); a rorating mechanism (H2) same as that shown in FIGS. 7 and 8 for rotating the empty can (a) positioned and stopped in the inspecting station (S2) forcibly about the axis of the empty can; a magnetic head (MGH) and a photo sensor (PH3) facing near one side of the outer periphery of the flange portion (a2) of the empty can (a) being rotated in the inspecting station (S2) as is shown in FIG. 18; photo sensors (PH1) and (PH2) facing both ends of the body portion (a3) of the empty can (a) where an omission or unevenness in printing is most likely to occur; a discriminator circuit (K) having a microcomputer (μCOM) for sorting out a defective can (a') by analyzing the electrical detection signals provided from the magnetic head (MGH) and photo sensors (PH1) (PH2) (PH3); and a rejector (R2) which sorts the defective empty can (a') from good empty cans (a'') upon receipt of a reject command signal from the discriminator circuit (K).

Explanation of the same parts with the same marks as those shown in FIGS. 7 and 8 is here omitted.

In the inspecting station (S2), as is illustrated on an enlarged scale with respect to its principal part in FIG. 18, the permanent magnet (PM) is disposed so as to face the center of the opening portion (a4) of the empty can (a) which is held in a sideways fallen state in the pocket (64) of the indexing turret (66) and stops in a predetermined position along arc-shaped parallel side guides (86) (88) and end guide (90); the magnetic head (MGH) is mounted just above the outer periphery of the flange portion (a2) of the empty can (a); and further the photo sensor (PH3) is positioned near one side of the flange portion (a2), while the photo sensors (PH1) and (PH2) are disposed so as to face both ends of the outer peripheral surface of the body portion (a3) of the empty can (a), and further disposed is the empty can spinner type rotating mechanism (H2) comprising a pair of parallel endless belts (96) and (98) adapted to run at high speed for transmission of driving torque to both sides of the central portion on one side of the outer periphery of the empty can (a) and being stretched between a driving wheel (100) and a driven wheel (102) so as to be engageable with the said portion of the empty can (a).

Figure 20:
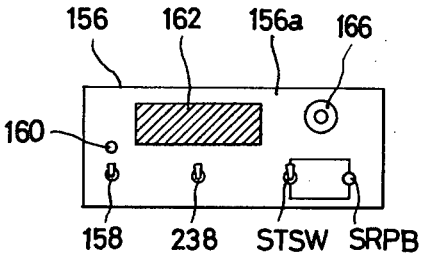
FIGS. 20 and 21 are front and rear views respectively of a case for housing the said discriminator circuit.
Figure 21:
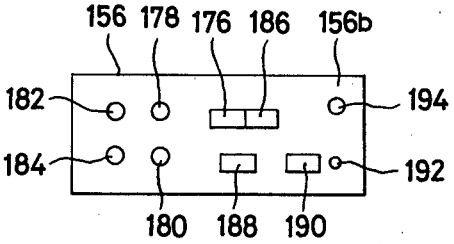
Figure 22:
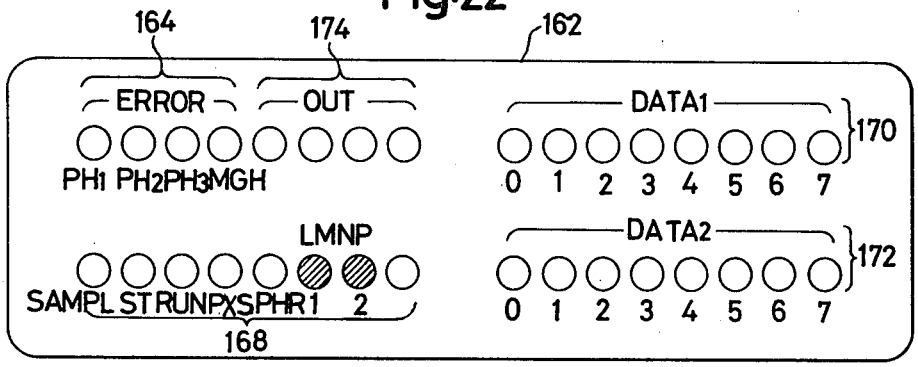
FIG. 22 is an enlarged view of a display panel in the apparatus of the invention.
Figure 19:
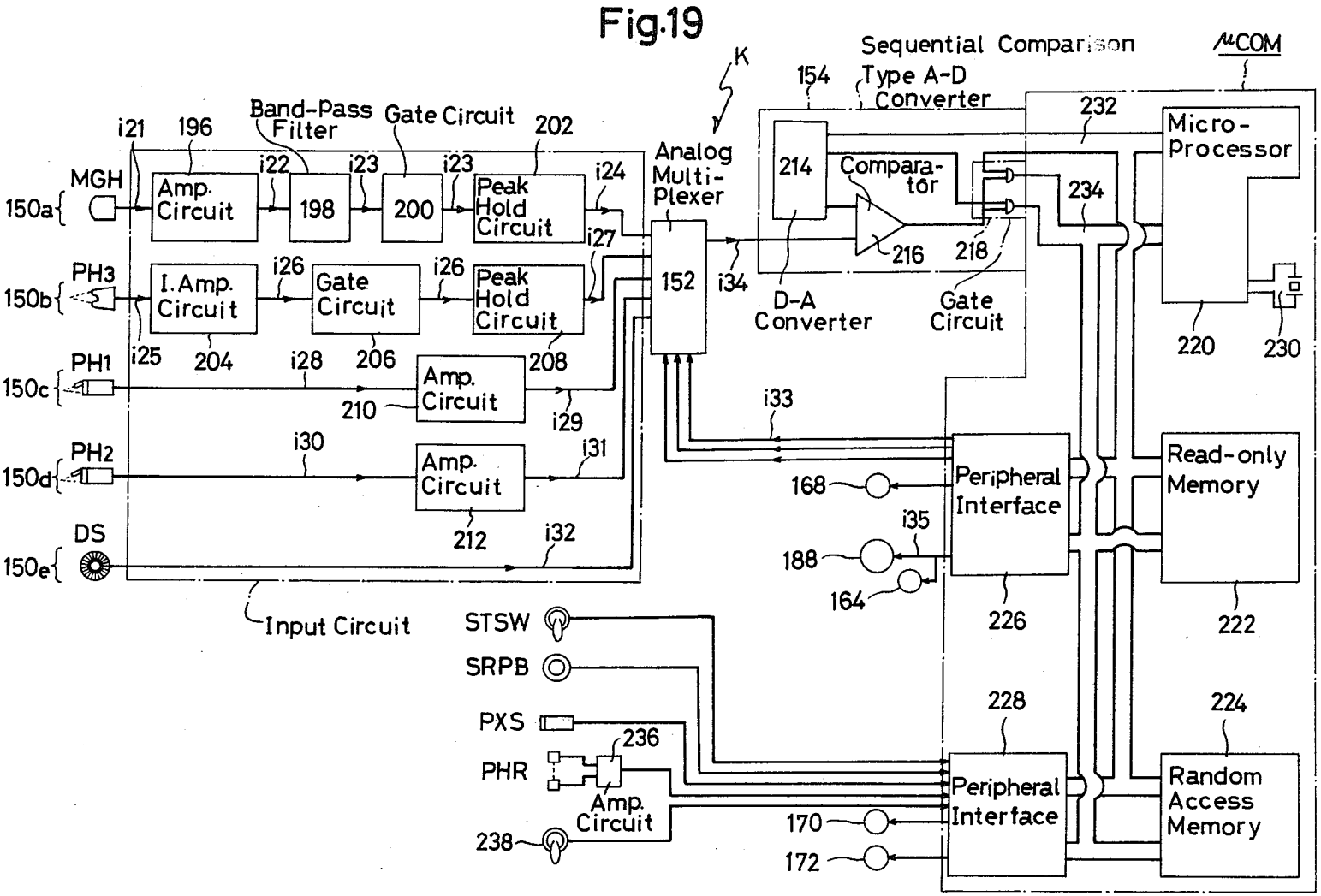
FIG. 19 is a block diagram of a discriminator circuit in the said embodiment.

The discriminator circuit (K), as shown in FIG. 19, comprises systematic connection of an input circuit (150), an analog multiplexer (152), a sequential comparison type A/D converter (154) and a microcomputer (μCOM), and it is housed in a case (156), the case (156) having such a front panel (156*a*) as shown in FIG. 20 and such a rear panel (156*b*) as shown in FIG. 21. On the front panel (156*a*) there are mounted a power switch (158); pilot lamp (160); a mode change-over switch (STSW) for switching the condition of the discriminator circuit (K) between Run mode which is an inspecting state for the empty can (a) under inspection passing inside the empty can feed/discharge mechanism (G2) and Stop mode in which standard data as a reference value signal is calculated and stored on the basis of the data collected from the good empty cans (a'') which is to be used as the standard of comparison at the time of detecting abnormality of the printed pattern in advance of Run mode; a sample reset push-button switch (SRPB) which acts according to the change-over position of the mode change-over switch (STSW), that is, in Stop mode, serves as a start switch for the said mode for storing the standard data obtained by calculation after collection of data from the good empty cans (a'') and in Run mode is used to manually reset the indication of error kind indicating light emission diodes (LED) (164) in a display panel (162) which is composed of LEDs; an operating dial (166) for a reference value corrector (DS) which, in the magnetic inspection by means of the permanent magnet (PM) and the magnetic head (MGH), is to correct during execution of Run mode the data as a reference value signal pre-stored in the microcomputer (μCOM); and the display panel (162) which consists of light emission diodes (LED) (168) for displaying the operating condition of the discriminator circuit (K), data indicating LEDs (170) and (172) which displays the collected data from the photo sensors (PH1) and (PH2) quantitatively in Stop mode and in terms of binary digits in Run mode, and reject command output indicating LEDs (174) which remain lit while a reject command signal is transmitted to the rejector (R2). On the other hand, mounted on the rear panel (156*b*) are connectors (176), (178), (180), (182), (184) and (186) for connecting the proximity switch (PXS) sttached to the empty can feed station (S1), the magnetic head (MGH) and the photo sensors (PH3) (PH1) (PH2) attached to the inspecting station (S2) and the photo switch (PHR) attached to the discharge station (S3); and further a connector (188) for connecting the rejector (R2). In the drawing, the reference numeral (190) is a power terminal, (192) is an earth terminal and (194) is a fuse holder.

As illustrated in FIG. 19, the input circuit (150) has the following five channels, an input channel (150*a*) of the magnetic head (MGH), an input channel of the photo sensor (PH3), input channels (150*c*) (150*d*) of the photo sensors (PH1) (PH2) respectively, and an input channel (150*e*) of the reference value corrector (DS). The input channel (150*a*) comprises in a series connected condition an amplifier circuit (196) which amplifies a signal (i21) from the magnetic head (MGH) and outputs an amplified signal (i22); a band-pass filter (198) which attenuates components unnecessary for the discrimination contained in the signal (122) which are caused for example by mechanical vibrations during rotation of the empty can (a) and sorts out only the necessary components as a signal (i23); a gate circuit (200) which controls the conduction of the signal (i23); and a peak hold circuit (202) which holds the maximum value out of the signals (i23) corresponding to one rotation of the empty can (a) energized upon conduction of the gate circuit (200) and outputs a certain signal (i24) of that value. The input channel (150*b*) comprises in a series connected condition an inverter amplifier circuit (204) which not only normally amplifies a larger value signal (i25) (plus signal) than a preset level and outputs an amplified signal (i26) but also, with respect to a lower value signal (i25) (minus signal) than the preset level, inverts its polarity and outputs an amplified signal (i6) as a plus signal so that also the minimum value of the lower value signal (i25) than the preset level may be held in the following peak hold circuit (208) for discrimination of defective cans (a') such as empty cans defective in flange length, for example, when the quantity of reflected light returning to the photo sensor (PH3) is minimum; that is, in the case where the flange portion (a2) is cracked or chipped or the flange length is insufficient because the height of the empty can (a) was not exactly trimmed in the trimming process, in which case the projected light from the photo sensor (PH3) will pass without being reflected or the quantity of reflected light becomes extremely small; a gate circuit (206) which controls the conduction of the signal (i6); and the peak hold circuit (208) which holds the maximum value (in the case of a lower level than the present level, namely in the case of the inverted amplification, minimum value) out of the signals (i26) corresponding to one rotation of the empty can (a) energized upon conduction of the gate circuit (206). The input channel (150*c*) comprises an amplifier circuit (210) which amplifies a signal (i28) from the photo sensor (PH1) and outputs an amplified signal (i29). The input channel (150*d*) comprises an amplifier circuit (212) which amplifies a signal (i30) from the photo sensor (PH2) and outputs an amplified signal (i31). The channel (150*e*) transmits a signal (i32) from the reference value corrector (DS).

The analog multiplexer (152) effects a selective switching for the five input channels (150*a*), (150*b*), (150*c*), (150*d*) and (150*e*) on the basis of a channel selection signal (i33) from the microcomputer (μCOM), further it transmits open/close command signals for the gate circuits (200) and (206) as well as lighting command signals for the projectors of the photo sensors (PH1), (PH2) and (PH3), and receives an input signal from the selected channel and outputs as an output signal (i34).

The sequential comparison type A-D converter (154), when the discriminator circuit (K) is in Stop mode, acts wholly as an A-D converter; that is, on the basis of the command of the microcomputer (μCOM) the analog multiplexer (152) makes an alternate selection of the signals (i29) and (i31) on the input channels (150*c*) and (150*d*) of the print pattern namely photo sensors (PH1) and (PH2), and the sequential comparison type A-D converter (154) makes an A-D conversion successively for the output signal (i34) and delivers it to the microcomputer (μCOM), while when the discriminator circuit (K) is in Run mode, the sequential comparison type A-D converter (154) also serves wholly as an A-D converter; that is, on the basis of the command of the microcomputer (μCOM) the analog multiplexer (152) makes an alternate selection of the signals (i29), (i31), (i24), and (i32) on the input channels (150*c*), (150*d*), (150*a*) and (150*e*) respectively of the photo sensors (PH1) (PH2), magnetic head (MGH) and reference value corrector (DS), and the sequential comparison type A-D converter makes an A-D conversion successively for the output signal (i34) and delivers it to the microcomputer (μCOM). On the other hand, for the signal (i34) resulting from selection by the analog multiplexer (152) of the signal (i27) on the input channel (150) of the photo sensor (PH3), the sequential comparison type A-D converter (154) acts wholly as a comparator; that is, the reference value signal pre-stored in a read-only memory (187) of the microcomputer (μCOM) is converted to an analog quantity, then the reference value signal after the D/A conversion is compared with the signal (i34) and when the latter deviates from the allowable range, a pulse signal as a comparison signal is delivered to the microcomputer (μCOM). In the drawing, the reference numerals (214), (216) and (218) designate a D/A converter, a comparator and a gate circuit respectively in the operation as a comparator.

The microprocessor (μCOM) comprises a microprocessor (220) which controls the operation of the discriminator circuit (G) and also performs arithmetic operation for input data; a read-only memory (222) in which are stored by a writing unit such as a P-ROM writer the defective empty can sorting out program as well as the reference value signal for discrimination of defects of the flange portion (a2), that is, for comparison of the signal obtained through the magnetic head (MGH) and the photo sensor (PH3); a random access memory (224) for storing input data etc.; and peripheral interfaces (226) (228), the peripheral interface (226) functioning to intermediate for the analog multiplexer (152), operation status indicating LEDs (168), the rejector (R) through the medium of the connector (188), and the error kind indicating LEDs (164), and the peripheral interface (228) functioning to intermediate for the mode change-over switch (STSW), the sample reset push-button switch (SRPB), the proximity switch (PXS), the photo switch (PHR) and the data indicating LEDs (170) (172). In the drawing, the reference numeral (230) is a clock generator for generating a 20 MHz clock pulse, (232) is an address bus, (234) is a data bus, (236) is an amplifier circuit of the photo switch (PHR), and (238) is a standard data calculation method selecting change-over switch as will be described later in connection with the discrimination of defective print cans.

Another embodiment of the method of this invention to which is applied the flange crack tester (D2) is here described in detail with reference to FIG. 7 and FIGS. 18 through 28.

The empty cans (a) are conveyed continuously to the empty can feed station (S1) in the empty can feed/discharge mechanism (G2), and the empty cans (a) which have entered the empty can feed station (S1) are arranged in a row along and within the empty can feed path (68) by means of the timing screw (72), and by turning once the timing screw (72) through rotation of the infeed drive shaft (76) in synchronism with the intermittent indexing rotation of the indexing turret (66), one of the pockets (64) in the indexing turret (66) arrives at the empty can feed station (S1), to which is delivered one of the empty cans (a) whereupon the proximity switch (PXS) turns on.

Figure 26:
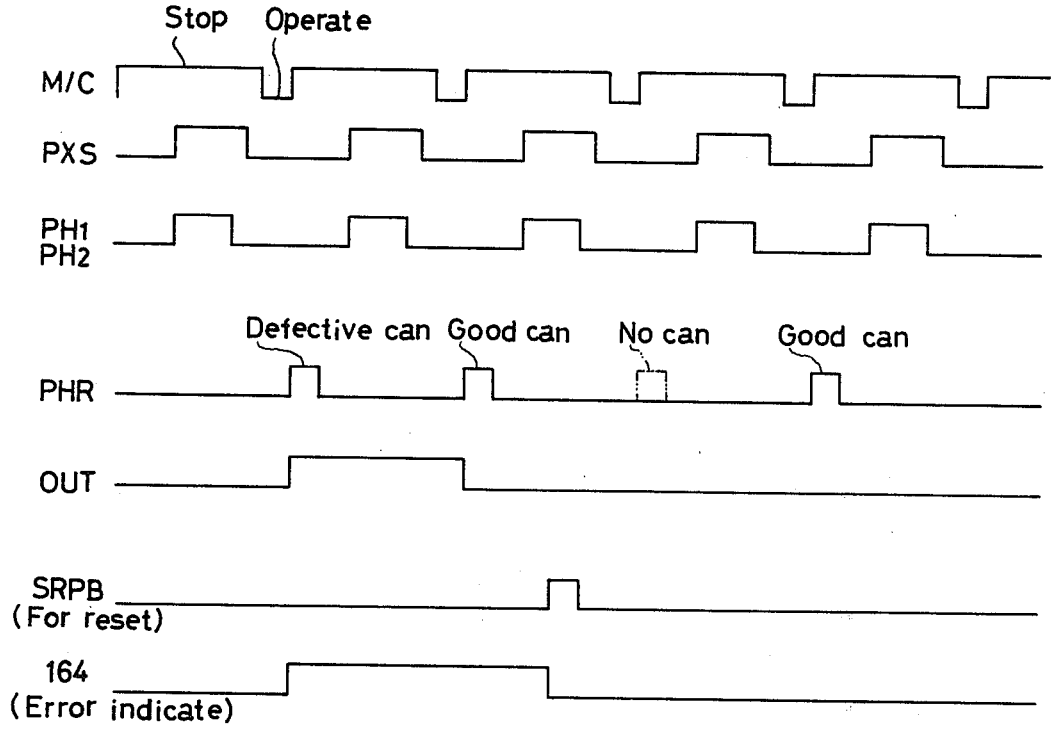

The empty can (a) which has been received in a sideways fallen state into the pocket (64) at the empty can feed station (S1) is guided by the parallel arc-shaped side guides (86) (88) and end guide (90) along with the intermittent indexing rotation of the indexing turret (66) shown in terms of an operating waveform M/C in FIG. 26 and is brought into contact with the endless belts (96) and (98) of the can spinner type rotating mechanism (H2) in the inspecting station (S2) whereupon it stops in that position.

When the empty can (a) has stopped in the predetermined position in the inspecting station (S2), as shown in FIG. 18, the can spinner type rotating mechanism (H2) is driven, thus allowing the empty can (a) to be forcibly rotated at high speed (2000 rpm). In the case of Run mode for sorting the defective empty can (a') from the empty cans (a), there are here performed data collection and discrimination. In this case, it is necessary that data collected from the good empty can (a'') as the basis of comparison should be stored beforehand in the random access memory (224) of the discriminator circuit (K) in connection with the print pattern defect discrimination in Stop mode, and that the standard data obtained from the above collected data should be stored as a reference value signal for the discrimination of a print pattern defect.

In Stop mode, the good empty can (a'') free from defects is brought to the inspecting station (S2) in the hereinabove described manner whereupon the empty can feed/discharge mechanism (G2) is stopped operation, and the good empty can (a'') is rotated in the predetermined position in the inspecting station (S2) by means of the rotating mechanism (H2), while the discriminator circuit (K) is brought into Stop mode by the operation of the mode change-over switch (STSW).

The detection principle for cracks etc. is as previously described in connection with FIGS. 13 through 16. The signal (i21) from the magnetic head (MGH) is amplified by the amplifier circuit (196) in the input channel (150) of the discriminator circuit (K) shown in FIG. 19, then by the band-pass filter (198) the amplified signal is increased in S/N ratio and shaped like the signal (i23) shown in FIG. 16, which is then transmitted to the peak hold circuit (202) upon conduction command for the gate circuit (200) from the microcomputer (μCOM).

In the data collection by the photo sensor (PH3) located near the flange portion (a2), the reflected light quantity from the light radiated to the flange portion (a2) is converted to the electrical signal (i25), which is then amplified by the inverter amplifier circuit and transmitted to the peak hold circuit (208) upon conduction command for the gate circuit (206) from the microcomputer (μCOM).

For sorting out the empty can (a) in which there exists a printing defect such as omission or uneveness in printing of the pattern printed on the outer peripheral surface of the body portion (a3) of the empty can (a), the reflected light quantity from the light radiated to the rotating empty can (a) based on changes in the print pattern along with the rotation is converted to electrical signals (i28) and (i30), which are then amplified by the amplifier circuits (210) and (212), respectively.

Figure 23:
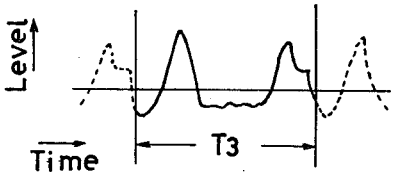
FIGS. 23 and 24 illustrate how signals converted from the quantity of reflected light from the printed surface shift with the lapse of time.
Figure 24:
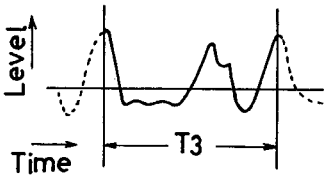
Figure 25:
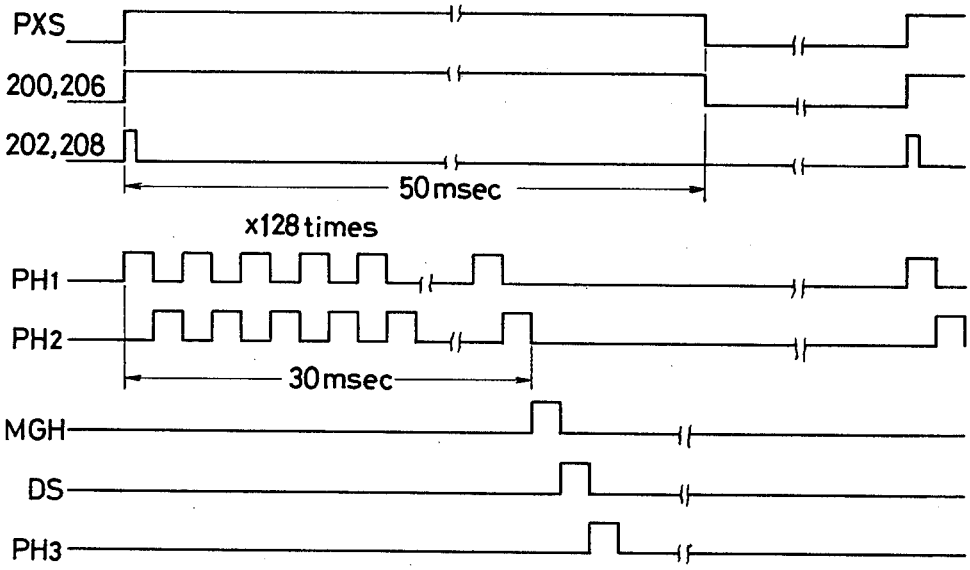
FIGS. 25 and 26 are an input timing chart and operation timing chart respectively of various portions of the aparatus of the invention.

As to the inputs through the input channels (150*c*) and (150*d*), in the Stop mode the proximity switch (PXS) is manually turned on and the sample reset push-button switch (SRPB) also turned on, resulting in that the analog multiplexer (152) designates the inputs channel (150*c*) of the photo sensor (PH1) and the input channel (150*d*) of the photo sensor (PH2) alternately and respectively by 128 times while its inputs the signals corresponding to one rotation of the forcibly rotating good empty can (a″) in a divided form to 128 signals. The divided input signals (i29) and (i31) are subjected to A-D conversion successively by the comparison type A-D converter (154), then are input and stored into the microcomputer (μCOM). And on the basis of these collected data, standard data is calculated; that is, the signals (i28) and (i30) from the photo sensors (PH1) and (PH2) are based on changes in the reflected light quantity from the empty can (a) being rotated (2000 rpm) by the rotating mechanism (H2) which changes in the reflected light quantity are based on changes in the printed pattern, so even when two empty cans (a) have the same print pattern free from printing defect and from both cans there are collected data corresponding to one rotation (T3) as shown in FIGS. 23 and 24, the resulting measured data are from different points and are timewise shifted from each other, so that it is impossible to make a direct comparison between the data which have been collected and stored in advance from the good empty can (a″) and the data collected from the empty can (a) being checked, therefore standard data as a reference value signal is calculated and stored on the basis of the data which have been collected and stored from the good empty can (a″).

Figure 27:
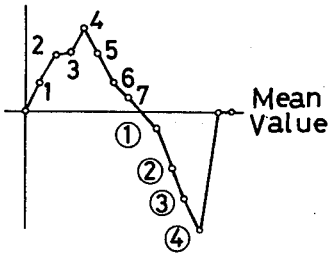
FIGS. 27 and 28 illustrate how to calculate standard data.
Figure 28:
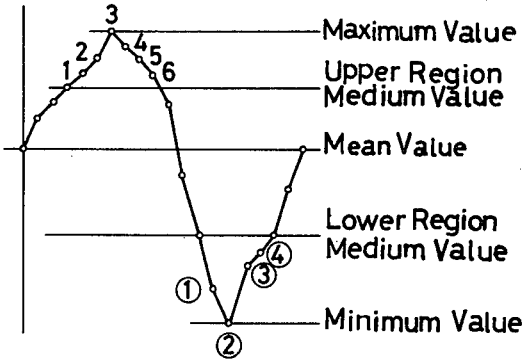

The calculation method for standard data is the same in both cases of PH1 and PH2, so an explanation is here given with respect to only PH1. There are the following three methods: a method ① in which data sampled at 128 points during one rotation of the empty can (a) are totalled and the average thereof is obtained, which is used as standard data; a method ② in which, as shown in FIG. 27, on the basis of the mean value obtained in the above method ①, the number of points above the mean value and that therebelow are calculated and the results are used as standard data, in which method ② the proportion of the printed pattern to the mean value which was unobtainable in the method ① is compared in divided upper and lower regions, so that in the case of a print pattern which exhibits a sudden change in a short time the number of such points is small, while in the case of a simple pattern with less changes the number of such points becomes larger; and further a method ③ in which, as shown in FIG. 28, the maximum and minimum values of all the measured data are obtained and further medium values from the mean value to the maximum value and from the mean value to the minimum value are obtained, then the number of points above the upper region medium value and that below the lower region medium value are separately counted and the results are used as standard data, in which method ③, since in the vicinity of mean value there are most variations in the number of points, the ratio of change of pattern is compared near the maximum value and minimum value to avoid such variations. In both Stop mode and Run mode, when sampling data from the empty can (a), the sampled data have variations, so measures must be taken in order that the good empty can (a″) may not be removed in Run mode. In the Stop mode, therefore, no matter which of the above three methods is to be adopted for calculating standard data, the good empty can (a″) is rotated by a desired number of rotations (e.g. 10 rotations) and standard data (mean value in the calculation method ① and the number of points in the calculation methods ② and ③) is obtained, and in the case of ten rotations the maximum value out of ten standard data is used as standard data.

Which of the above three calculation methods is to be adopted for obtaining and storing standard data as a reference value signal should be decided according to the pattern printed on the outer peripheral surface of the body portion (a3) of the empty can (a) to be checked. For example, in case the printed pattern is white alone or plain, the method ① should be adopted, and in the case of a colorful printed pattern the method ② or ③ should be adopted. Then, the results obtained by a suitable method are stored as standard data as a reference value signal. The selection of these methods can be made by a standard data calculation method selecting change-over switch (238).

When the above-mentioned data sampling from PH1 and PH2 and storing of standard data are over, the operation status indicating LEDs will light at "SAMPLE," advising the termination of the said operations.

After the hereinabove described Stop mode, there is started Run mode, namely a defective empty can sorting out operation, for which operation the empty can feed/discharge mechanism (H2) is started and the mode change-over switch (STSW) is turned to the Run mode position. Then, it should be confirmed that the operation status indicating LEDs (168) on the display panel (162) lights at "RUN" and the sorting out operation was started, that is, the discriminator circuit (K) is now in Run mode. The disscriminator circuit (K) thus in Run mode operates according to the input timing chart shown in FIG. 25 and the operation timing chart shown in FIG. 26. Along with the intermittent rotation M/C of the indexing turret (66) in the empty can feed/dischange mechanism (G2), the empty can (a) to be checked arrives at the inspecting station (S2) and begins to rotate (2000 rpm) by the rotating mechanism (H2), whereupon the proximity switch (PXS) as a timing sensor turns on. With this as a turning point, the gate circuits (200) and (206) of the input channels (150*a*) and (150*b*) respectively are brought into a conducting state, allowing the peak hold circuits (202) and (208) to clear the previous maximum values so far held and reset, which peak hold circuits (202) and (208) then operate to hold the maximum values of the signals (i23) and (i26), respectively. At the same time, the signals (i29) and (i31) corresponding to one rotation of the empty can (a) sent from the photo sensors (PH1) and (PH2), which sensors inspect the outer peripheral surface of the body portion (a3) of the empty can (a), are each successively divided into 128 equal parts by an alternate channel selection by means of the analog multiplexer (152), then transmitted to the sequential comparison type A-D converter (154) and after A-D conversion by the converter (154), are input and stored into the microcomputer (μCOM), where the data are processed in the same manner as in the foregoing calculation of standard data (provided the rotation of the empty can (a) is once in the Run mode) and the value thereby obtained is compared with the standard data as a reference value signal which is pre-stored in the foregoing Stop mode, and if it is outside the allowable range, the empty can (a) being inspected is judged as defective can (a').

Next, the input channel (150*a*) is selected by the analog multiplexer (152) and the signal (i24) of the maximum value among the values corresponding to one rotation of the empty can (a) held in the peak hold circuit (202) is delivered to the sequential comparison type A-D converter (154), then it is compared by the comparator (216) with the value resulting from D-A conversion by the D-A converter (214) of the standard data as a reference value signal (the maximum value among the values corresponding to one rotation of the good standard empty can (a'') sampled from the can (a'') and determined in consideration of variations) which is written and stored beforehand in the read-only memory (222), and if it is outside the allowable range, the comparator (216) outputs a pulse signal and tha gate circuit (218) allows the passing of the pulse signal, so that the pulse signal inputs to the microcomputer (μCOM) and it is judged that the empty can being inspected is a defective empty can (a').

In the Run mode, if it is necessary to change the contents of the reference value signal for comparison of the signal (i24) which is written and stored in the read-only memory (222), the said contents can be changed freely by operating the reference value corrector (DS).

Next, the input channel (150*b*) is selected by the analog multiplexer (152) and the signal (i27) of the maximum value among the values corresponding to one rotation of the empty can (a) held in the peak hold circuit (208) (in the case of a lower level then the pre-set level, a value obtained by inversional amplification of the minimum value) is delivered to the sequential comparison type A-D converter (154), then it is compared by the comparator (216) with the value resulting from D-A conversion by the D-A converter (214) of the standard data as a reference value signal (the maximum and minimum values among the values corresponding to one rotation of the good standard empty can (a'') sampled from the can (a'') and determined in consideration of variations) written and stored beforehand in the read-only memory (222), and if it is outside the allowable range, the comparator (216) outputs a pulse signal and the gate circuit (218) allows the passing of the pulse signal, so that the pulse signal inputs to the microcomputer (μCOM) and it is judged that the empty can being inspected is a defective empty can (a').

Then, the defective empty can (a') leaves the inspecting station (S2) along with the intermittent pivotal movement of the indexing turret (66) and passes through the photo switch (PHR) as a reject timing sensor mounted in the discharge station (S3), whereupon the photo switch (PHR) turns on, and at this moment a reject command signal (i35) ("OUT" in FIG. 26) is output to the rejector (R), which in turn selectively removes the defective empty can (a'). It goes without saying that, among the detection signals from the photo sensors (PH1)(PH2) which inspect the outer peripheral surface of the body portion (a3) of the empty can (a) and from the magnetic head (MGH) and photo sensor (PH3) which inspect the flange portion (a2), if an abnormal condition is detected in any of them, the reject command signal (i35) is output and the defective empty can (a') is selectively removed by the rejector (R). Issuance of the reject command signal (i35) is indicated by lighting of the error kind indicating LEDs (164) on the display panel (162) whereby it is made possible to known in which of PH1, PH2, MGH and PH3 the defect was detected and consequently to known in which of the printing step, flange processing step, etc. the defect was generated, and further to take countermeasures. In addition, by lighting of the reject command output indicating LEDs (174) it is made possible to easily confirm whether a reject command has been issued or not, that is, whether the empty can being inspected is a good empty can (a'') or defective empty can (a'). The reject command signal (i35) and the reject command output indicating LEDs (174), if the next empty can (a) is a good empty can (a''), are turned off at the reject timing for the good empty can (a''). The error kind indicating LEDs (164) change their indication when the next defective empty can (a') was detected, or can be turned off by depressing the sample reset push-button switch (SRPB) since the discriminator circuit (K) is in Run mode.

What is claim is:

1. A method for inspecting empty cans entirely automatically in a can manufacturing system, comprising a flange portion inspecting step in which an empty can is forcibly rotated while the flange portion thereof is checked for cracks and length employing non-destructive contactless testing with a static electromagnetic inspection and a light reflection inspection, and further comprising a print quality inspecting step in which the print quality on the outer peripheral surface of said can is checked for the drawing condition of a printed pattern by light reflection inspection, said static electromagnetic inspection and both of said light reflection inspections being carried out simultaneously, whereby defective cans are sorted out from good cans.

2. A method for inspecting empty cans entirely automatically as defined in claim 1, in which the print quality inspecting step comprises radiating light onto the outer peripheral surface of an empty can, acquiring reflected light from said outer peripheral surface varying according to changes in the drawing condition of a printed pattern along with rotation of the empty can, converting said reflected light into an electrical signal, comparing said electrical signal with a pre-stored reference value signal being a signal of a value that is a determined function of sampled equally divided signal values corresponding to one rotation of a forcibly rotated standard good empty can.

3. A method for inspecting empty cans entirely automatically as defined in claim 1, in which said forcible rotation of the empty can is effected by exerting a frictional turning force on one side of the body portion of the empty can while maintaining the latter on its horizontal axis.

4. A method for inspecting empty cans entirely automatically as defined in claim 1, in which said flange portion inspecting step comprises placing the flange portion of the rotating empty can within a static magnetic field, converting the amount of change in the distributed magnetic flux density into an electrical signal, simultaneously converting the amount of reflection of light radiated onto said flange portion into an electrical signal, and comparing each of said electrical signals with prestored reference value signals being the maximum and minimum values among the signal values corresponding to one rotation of a forcibly rotated standard good empty can.

5. An apparatus for inspecting empty cans entirely automatically comprising an empty can feed/discharge mechanism for conveying a continuously incoming group of empty cans to a predetermined position in an inspecting station intermittently one by one in an equally spaced manner, a rotating mechanism for forcibly rotating an empty can which has been positioned and stopped in said inspecting station, a permanent magnet for exerting a static magnetic field on the flange portion of the rotating empty can in said inspecting station, a magnetic head positioned to detect a change of static magnetic field in a can at said station and convert it into an electrical signal, a photo sensor positioned to receive an amount of reflection of light radiated onto the flange portion in a can at said station and convert it into an electrical signal, photo sensors mounted to receive an amount of reflection of light radiated onto the outer peripheral surface of an empty can at said station, said reflection amount varying in dependence upon the drawn condition of the printed pattern, a discriminator circuit connected to compare the electrical signals from said magnetic head and said photo sensors with respective reference signals, a microcomputer connected to calculate and store said reference values, said discriminator being connected to output a reject command signal, and a rejector for sorting defective empty cans from good empty cans upon receipt of a reject command signal output from said discriminator circuit.

6. The apparatus for inspecting empty cans entirely automatically as defined in claim 5, in which said empty can feed/discharge mechanism has an empty can feed station, said empty can feed station being provided with a timing sensor disposed near one side of a timing plate mounted on an infeed drive shaft, said infeed drive shaft intermittently driving a timing screw, said timing screw being mounted to arrange a continuously incoming group of empty cans in a row and move them intermittently one by one.

7. The apparatus for inspecting empty cans entirely automatically as defined in claim 5, in which said rejector includes a timing sensor for sensing the passing of an inspected empty can, said timing sensor being disposed near an inlet port of an empty can discharge path, and a sorting arm attached pivotably to a bifurcated branch point in said empty can discharge path, said sorting arm being adapted to pivot upon receipt of a reject command signal from said discriminator circuit to remove defective empty cans from good empty cans.

8. The apparatus for inspecting empty cans entirely automatically as defined in claim 5, in which said printed pattern inspecting photo sensors are mounted in positions respectively facing the upper end and the lower end of the outer peripheral surface of the empty can under inspection.

9. An apparatus for inspecting empty cans entirely automatically comprising an empty can feed/discharge mechanism for conveying a continuously incoming group of empty cans to a predetermined position in an inspecting station intermittently one by one in an equally spaced manner, a rotating mechanism for forcibly rotating the empty can which has been positioned and stopped in said inspecting station, a permanent magnet for exerting a static magnetic field on the flange portion of the empty can being rotated in said inspecting station, a magnetic head positioned to detect a change of a static magnetic field in a can at said station and convert it to an electrical signal and a photo sensor mounted to receive an amount of reflection of light radiated onto the flange portion of a can in said station and convert it to an electrical signal, a photo sensor positioned to receive an amount of reflection of light radiated onto the outer peripheral surface of an empty can at said station on with the reflection amount varies according to the drawn condition of the printed pattern, a discriminator circuit connected to compare electrical signals from said magnetic head and said photo sensors with respective reference signals and output a reject command signal in response thereto, a microcomputer connected to calculate and store said reference values, and a rejector for sorting defective empty cans from good empty cans upon receipt of a reject command signal output from said discriminator circuit, said discriminator circuit comprising an input circuit, said input circuit having input channels for the magnetic head and photo sensor which inspects the flange portion of the empty can and for the photo sensor which inspects the pattern printed on the outer peripheral surface of the empty can; an analog multiplexer connected to select said input channel of said input circuit in accordance with a selection command from said microcomputer and to output a detection signal on the selected input channel; a sequential comparison A-D converter for A-D conversion and analog comparison; said microcomputer being programmed to discriminate a defective empty can on the basis of detection signals and comparison signals transmitted from said sequential comparison A-D converter, display the input channel which has detected the defect and issue a command for removal of the defective empty can to the rejector, said input circuit, said analog multiplexer, said sequential comparison A-D converter and said microcomputer being operatively connected together.

10. The apparatus for inspecting empty cans entirely automatically as defined in claim 9, in which said sequential comparison A-D converter is connected to effect the A-D conversion of a detection signal transmitted from said analog multiplexer in accordance with a command from said microcomputer in correlation with the magnetic head and with the photo sensor which inspects the pattern printed on the outer peripheral surface of the empty can, and to deliver the converted signal to the microcomputer, said A-D converter also being connected as a comparator to effect the D-A conversion of a reference value signal pre-stored in said microsomputer, compare the reference value signal after D-A conversion with a detection signal transmitted from said analog multiplexer and being in correlation with the magnetic head which inspects the flange portion of the empty can under inspection and, if there is a difference, to output a pulse signal as a comparison signal.

11. The apparatus for inspecting empty cans entirely automatically as defined in claim 9, in which the input channel of the magnetic head and the input channel of the flange portion inspecting photo sensor are each provided with a peak hold circuit which holds the maximum value of positive signals detected from the rotating empty can under inspection and positive signals from inversion of negative signals also detected from said empty can.

12. The apparatus for insepcting empty cans entirely automatically as defined in claim 9, in which the input channel of the flange portion inspecting photo sensor is provided with an inverter before the peak hold circuit and through the medium of a gate circuit, said inverter being connected to invert the polarity of negative detected signals and to amplify the input signals as positive signals.

* * * * *